US005209781A

United States Patent [19]

Milkie

[11] Patent Number: 5,209,781

[45] Date of Patent: May 11, 1993

[54] PAINT APPLICATOR

[76] Inventor: Terry H. Milkie, 3 Burtree Dr., Brampton, Ontario, L6Z 3K3, Canada

[21] Appl. No.: 727,851

[22] Filed: Jul. 10, 1991

Related U.S. Application Data

[63] Continuation-in-part of Ser. No. 683,842, Apr. 3, 1991, Pat. No. 5,117,527.

[51] Int. Cl.[5] ..... B05C 17/00

[52] U.S. Cl. ..... 118/264; 15/210.1

[58] Field of Search ..... 118/207, 264; 15/210 R, 15/104.94, 244.1

[56] References Cited

U.S. PATENT DOCUMENTS

| | | | |
|---|---|---|---|
| 2,810,148 | 10/1957 | Wood, Jr. | 15/210 R |
| 2,975,453 | 3/1961 | Imhof | 15/210 R |
| 3,599,265 | 8/1971 | D'Ercoli et al. | 15/210 R |
| 3,605,165 | 9/1971 | Burns | 15/210 R |
| 3,708,821 | 1/1973 | Chase et al. | 15/210 R |
| 3,722,019 | 3/1973 | Magnien | 15/210 R |
| 3,736,616 | 6/1973 | Seip | 15/210 R |

FOREIGN PATENT DOCUMENTS

| | | | |
|---|---|---|---|
| 1181230 | 2/1970 | United Kingdom | 15/210 R |

*Primary Examiner*—W. Gary Jones
*Assistant Examiner*—Charles K. Friedman
*Attorney, Agent, or Firm*—Smart & Biggar

[57] ABSTRACT

A paint applicator comprises a frame with a flat side which carries an absorbent pad; the other side of the frame supports a handle. The axles for a pair of rollers depend from a hinged mount supported on the handled face of said frame; the axles are parallel and are inclined toward one margin of the frame. The angle of the hinged mount with respect to the frame is adjustable. The rolling face of the rollers may have a circumferential groove such that, in use, the applicator may edge the paint on a surface adjacent a narrow moulding with a circumferential groove of the rolling surface of the rollers abutting the bevelled corner of the moulding. In another embodiment, the rollers have a knife-edged rolling face which abuts in the inside corner between the surface to be painted and the moulding. In a further embodiment, the rollers are replaced with a stationary knifed-edged abutment which is also intended to abut the inside corner between the surface to be painted and the moulding.

3 Claims, 11 Drawing Sheets

PAINT APPLICATOR

CROSS REFERENCE TO RELATED APPLICATION

This application is a continuation-in-part of application Ser. No. 07/683,842 filed Apr. 3, 1991 now U.S. Pat. No. 5,117,527.

BACKGROUND OF THE INVENTION

1. Field of the Invention

This invention relates to a paint applicator for applying paint to the edge of a first surface which forms an inside corner with a second surface.

2. Description of the Related Art

Wood, Jr. U.S. Pat. No. 2,810,148 issued Oct. 22, 1957 describes an applicator for applying paint at the edge of a surface which forms an inside corner with a perpendicular locating surface. The applicator comprises a frame with a flat side which carries an absorbent pad; the other side of the frame supports a handle. Two spaced rollers with axes of rotation perpendicular to the flat side of the frame are fixed to the frame so as to project below its base. The applicator may then be positioned so that the pad is against the surface to be painted with the rollers resting on the locating surface and the applicator may then be moved along the edge of the surface to be painted with the rollers rolling on the locating surface. In this way the locating surface locates the applicator so that paint may be applied to the edge of the surface to be painted closely adjacent the locating surface.

In a known modification of the applicator of the Wood, Jr. patent, the rollers are mounted on a support which is in turn mounted to the frame and may be adjusted to adjust the extent to which the rollers project beyond the base of the frame.

A problem arises where the adjacent locating surface is narrower than the distance between the rollers and the absorbent pad or where the locating surface slopes. In such circumstances the rollers of the known applicators may fail to obtain a purchase on the locating surface.

This invention seeks to overcome drawbacks of known paint applicators.

SUMMARY OF THE INVENTION

According to this invention, there is provided a paint applicator for applying paint to the edge of a first surface which forms an inside corner with a second surface, comprising the following: a frame having a flat front face for carrying a paint absorbent pad and a back face; a handle on the back face of said frame; a pair of rollers spaced along the handled back face of said frame having generally parallel axes of rotation inclined toward one margin of said frame such that said rollers project beyond said margin of said frame and forwardly of said flat front face, the rolling face of each of said rollers comprising a knife edge, whereby, when a paint absorbent pad is carried by said flat front face of said frame and such pad abuts a first surface proximate an inside corner with a second surface, the knife edged rolling face of each of said rollers is intended to abut said inside corner where said first and second surfaces meet to thereby support said absorbent pad in spaced relation to said second surface.

BRIEF DESCRIPTION OF THE DRAWINGS

In the figures which disclose example embodiments of the invention.

DESCRIPTION OF THE PREFERRED EMBODIMENTS

Figure 1:
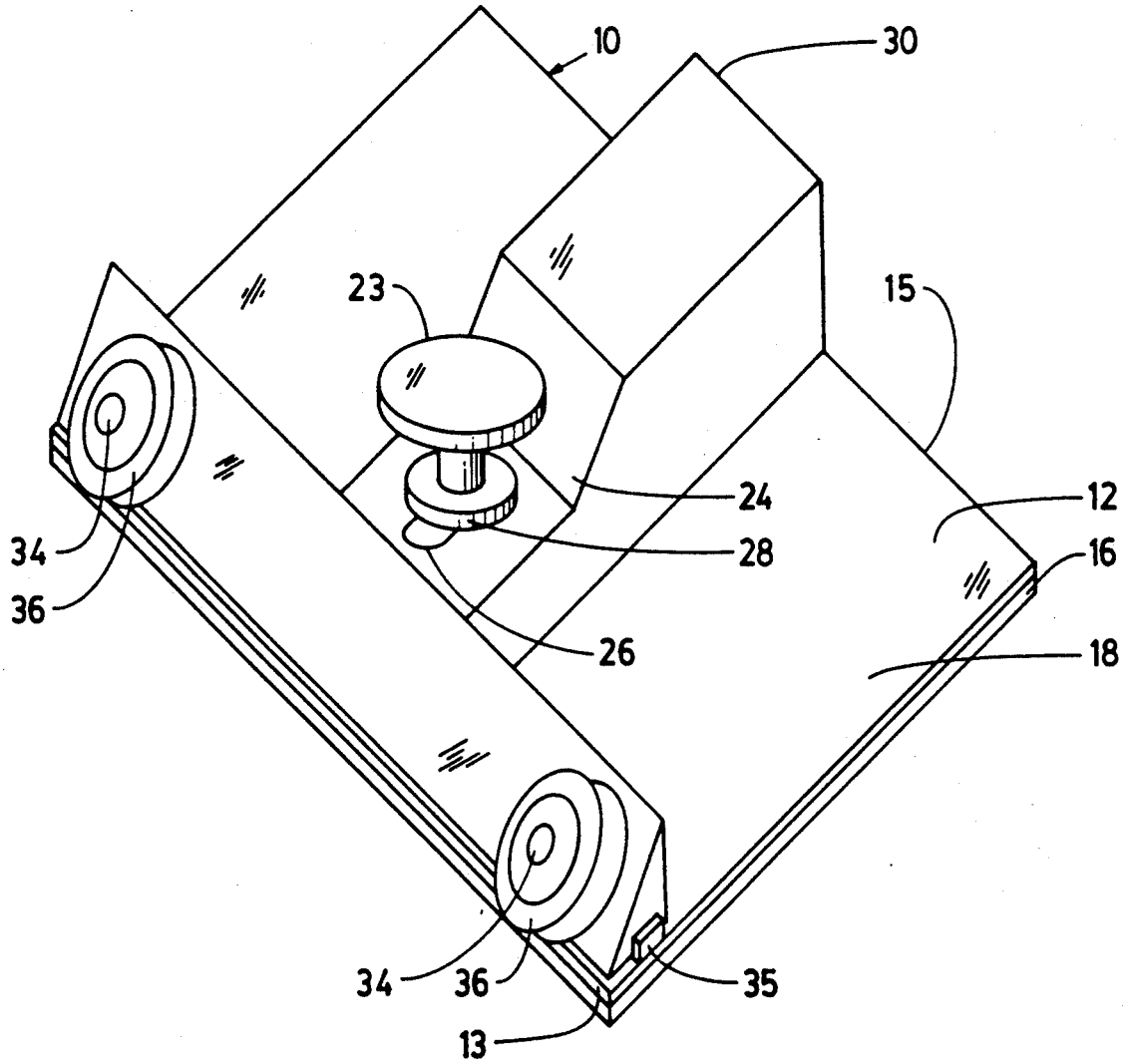
FIG. 1 is a perspective view of a paint applicator made in accordance with this invention.
Figure 2:
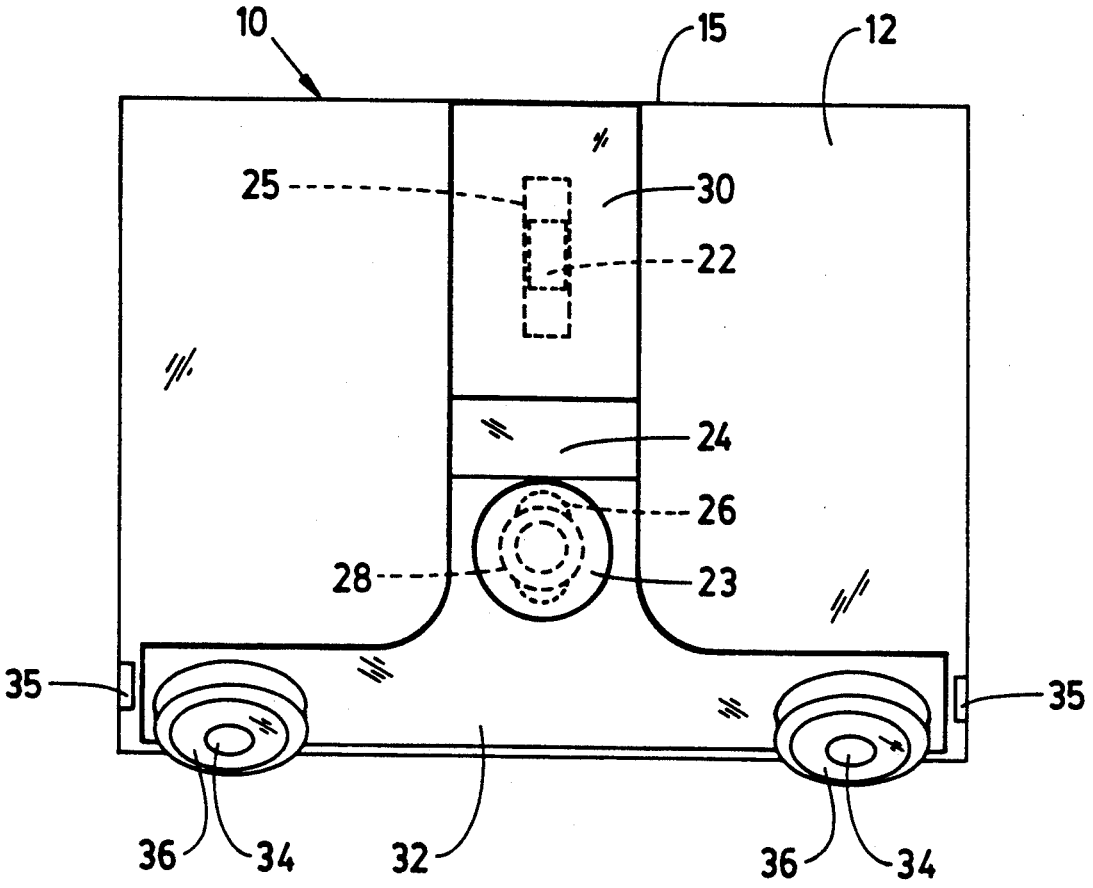
FIG. 2 is a back view of the applicator of FIG. 1.
Figure 3:
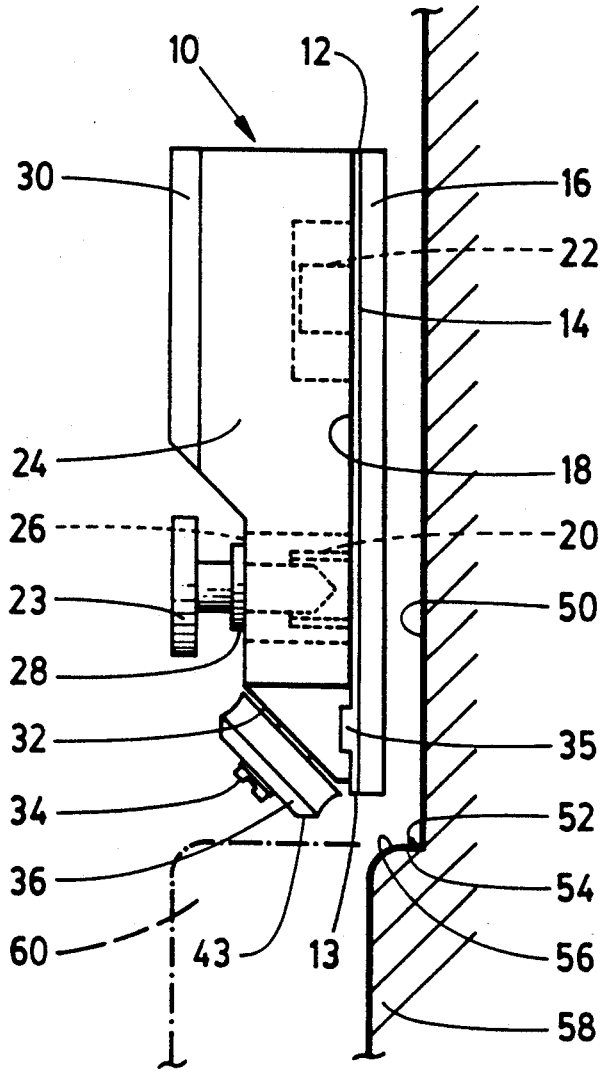
FIG. 3 is a side view of the applicator of FIG. 1 showing the applicator proximate a surface to be painted.

With reference to FIGS. 1 through 3, a paint applicator 10 comprises a frame 12 having a top margin 15, a bottom margin 13, a flat front face 14, and a back face 18. The flat front face supports a paint absorbent pad 16. The back face 18 of the frame has an internally threaded cylinder 20 and a guide 22 projecting therefrom. A support 24 is clamped to back face 18 of the frame 12 by a shouldered bolt 23 which passes through elongate opening 26 in the support and is threaded to internally threaded cylinder 20 of the frame until shoulder 28 of the bolt abuts the support. An elongate opening 25 in the support receives guide 22 of the frame in order to align the support on the frame. The support has a handle 30 and a basal oblique face 32 from which two laterally spaced parallel axles 34 project normally. Due to the slope of oblique face 32, the two axles 34 are inclined toward the bottom margin 13 of the frame. Preferably, the angle of the oblique face is such that the axles make an angle of about forty-five degrees with the front face 14 of the frame. Each axle carries a roller 36 so that the rollers are spaced laterally along the handle side of the frame. The rollers project below the bottom margin 13 of the frame.

The vertical position of the support on the frame 12, and hence the distance the rollers project below the base margin 13 of the frame, may be adjusted by loosening bolt 23 and sliding the support up or down. The limit of the vertical adjustment is determined by the bolt contacting one of the ends of the elongate slot 26.

Figure 4:
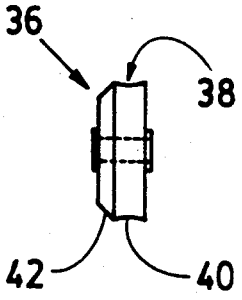
FIG. 4 is an end view of a roller used in the applicator of FIG. 1.

With reference to FIG. 4 as well as FIG. 3, the rolling face 38 of each roller 36 includes a circumferential groove 40. As well, the edge of rolling face 38 distal from the oblique surface 32 (and, hence, distal from the frame) has a circumferential flat surface 42 which is inclined toward the axis of rotation of the roller in a direction away from the frame 12. The angle of incline of axle 34 and the inclination of flat surface 42 is chosen so that the lowermost portion 43 of flat surface 42 of each roller is perpendicular to the flat front face 14 of the frame 12.

Figure 5:
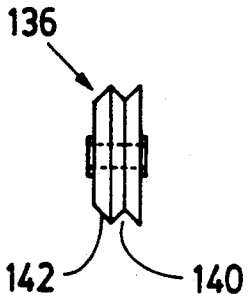
FIG. 5 is an end view of an alternate embodiment of a roller which may be used with the applicator of FIG. 1.
Figure 6:
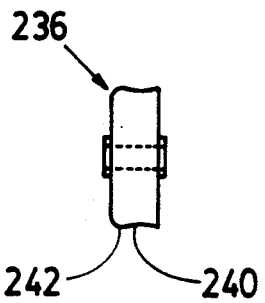
FIG. 6 is an end view of another embodiment of a roller which may be used with the applicator of FIG. 1.

FIG. 5 illustrates an alternate embodiment for the roller. With reference to FIG. 5, the circumferential groove **40*a* on the rolling face of roller 36*a* is angulated. The flat surface 42*a* on the rolling face is similar to the flat surface 42 of the roller 36 of FIG. 4. FIG. 6 illustrates a further alternate embodiment for the roller. Referring to FIG. 6, the rolling face of roller 36*b* has a circumferential groove 40*b* similar to the circumferential groove of the roller of FIG. 4. However, the edge of the rolling face comprising flat surface 42 of the roller of FIG. 4 has been replaced with a bevelled edge 42*b***.

The paint absorbent pad 16 may be affixed to the flat front face 14 of frame 12 by any suitable means, such as an adhesive backing on the pad. In order to accommodate one known style of pad which terminates at either side in resilient plastic hooks intended to snap over the side margins of the back face 18 of the applicator 10, stops 35 protrude from the back face 18 to provide an abutment surface for these hooks in order to locate such a pad on the applicator.

With reference to FIG. 3, the paint applicator 10 is for use in applying paint to the edge of a surface 50 which forms an inside corner 52 with a second, locating, surface 54. The locating surface 54 may be the top surface of a narrow moulding 58 having a bevelled corner 56. In such instance, in use, the applicator is positioned in abutment with the edge of surface 50 with the grooved portion 40 of the rolling face 38 of rollers 36 cupping bevelled corner 56 of moulding 58. The rollers thereby support the absorbent pad just above the surface 54 of the moulding. The applicator may then be moved from side to side with the rollers rolling along the bevelled corner of the moulding in order to apply paint along the edge of surface 50. It will be seen that the rollers of the applicator may be supported on a very narrow moulding due to the incline of the rollers toward the moulding.

The grooved portion of the rolling face will cup the bevelled corner, and hence support the applicator, where the slope of the bevelled corner either matches, or is steeper than that of the grooved portion of the rolling face. Hence a close match to the profile of the bevelled corner is not necessary. Where corner 56 of narrow moulding 58 is angulated, better support may be obtained with the roller of FIG. 5 with its angulated grooved surface **40*a***.

Where the moulding is wide, such as is illustrated in phantom at 60 in FIG. 3, surface 54 of the moulding — which is perpendicular to surface 50 — will project past the grooved surface 40 of the rollers. Since the front face 14 of the applicator will be parallel to surface 50 and the lowermost portion 43 of the rollers is perpendicular to the front face 14, the lowermost portion 43 will be parallel with, and will contact, the surface 54 of the moulding. Once again, the applicator may then be moved from side to side with the rollers rolling along surface 54 of the moulding in order to apply paint along the edge of surface 50.

Where the rollers **36*b* of FIG. 6 are substituted for the rollers of FIG. 4 and the moulding is wide, the bevelled corner 42*b* of the roller contacts surface 54 of the moulding. Rollers 36*b* are better suited to applications where surface 54 of the moulding is not exactly perpendicular to surface 50**.

Figure 7:
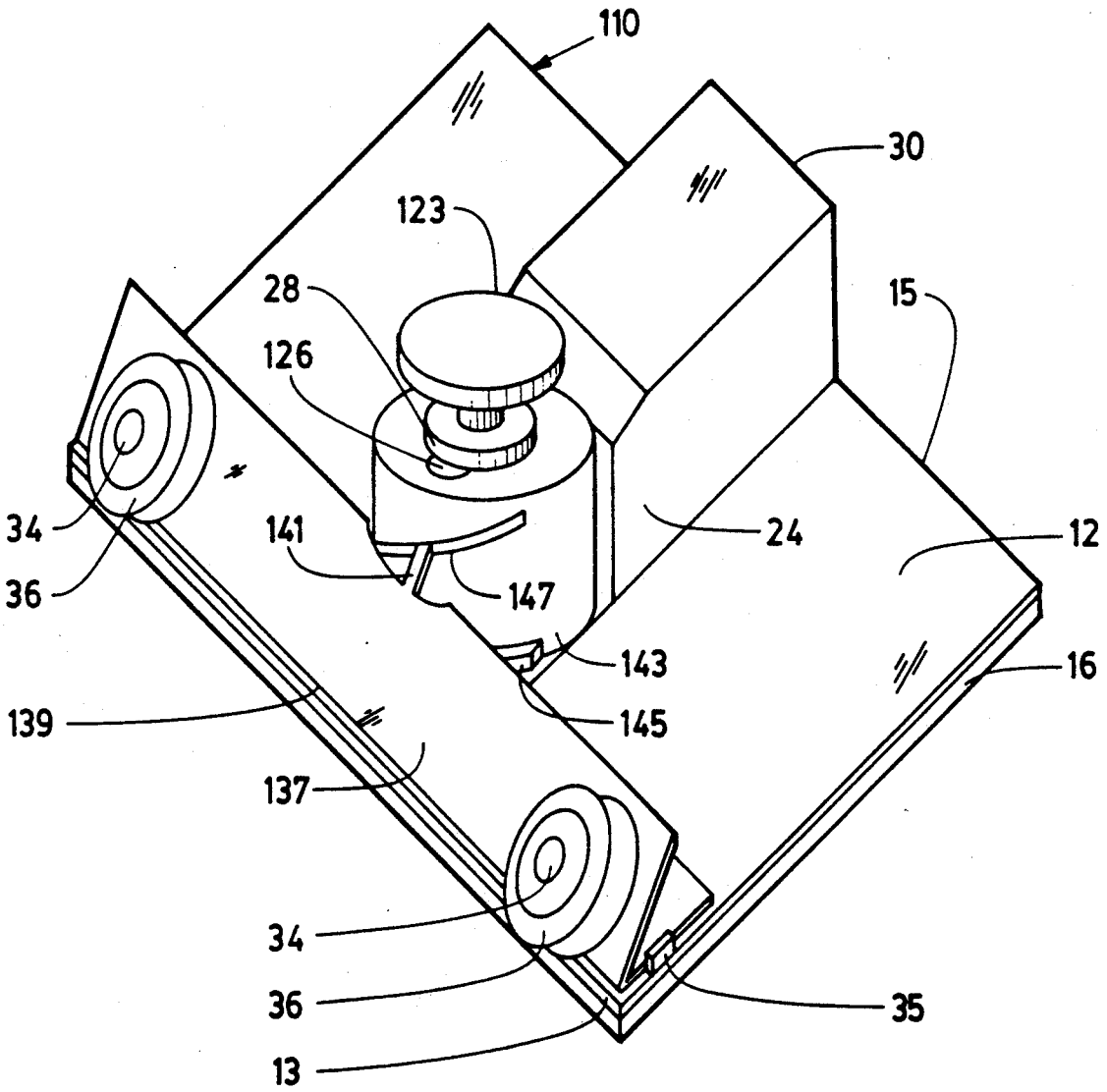
FIG. 7 is a perspective view of an alternate embodiment of a paint applicator made in accordance with this invention.
Figure 8:
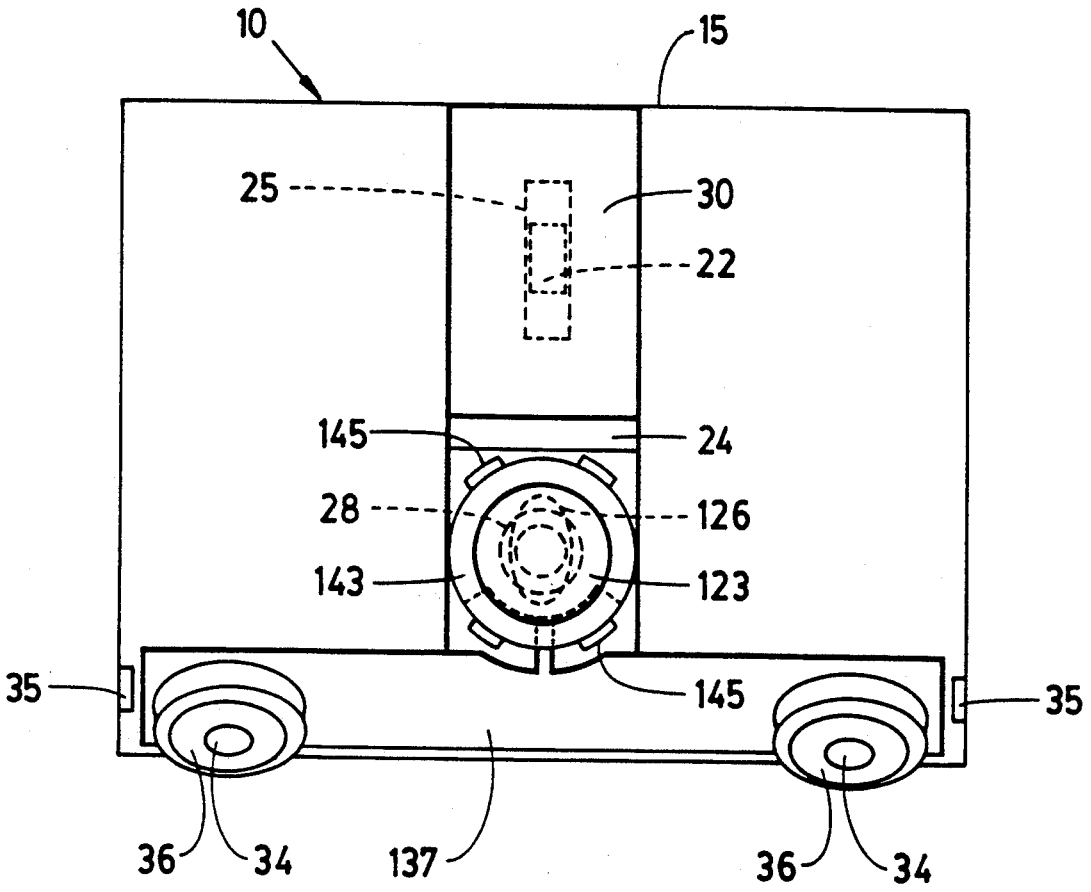
FIG. 8 is a back view of the applicator of FIG. 7.
Figure 9:
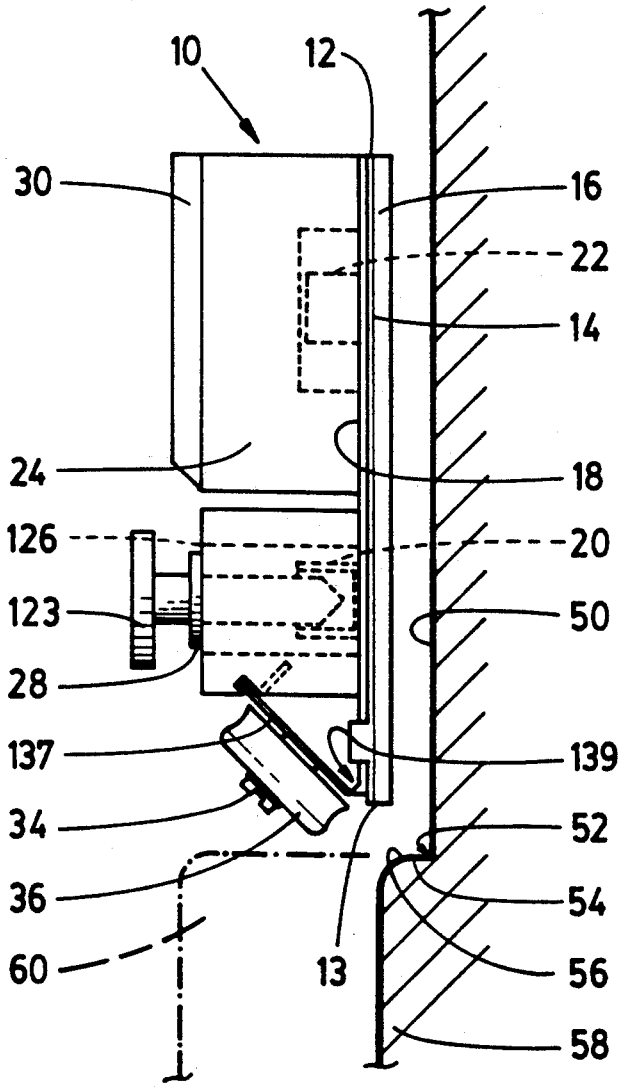
FIG. 9 is a side view of the applicator of FIG. 7 showing the applicator proximate a surface to be painted.

FIGS. 7 through 9 illustrate an alternate embodiment for the paint applicator of this invention. Turning to these figures, wherein like parts have been designated with like reference numerals, the paint applicator 110 comprises hinged mount 137 which is connected to support 24 at hinge 139. As shown, hinge 139 is a reduced width resilient margin along the edge of the hinged piece 137 such that the hinged piece 137 is integrally formed with the support 24. The roller axles 34 are mounted to the hinged mount. A tag 141 extends from the hinged mount.

A cylinder 143 is located on support 24 by arcuate supports 145. The cylinder has an elongated through bore 126; a slot 147 extends along the side of the cylinder and is angled such that one end of the slot is proximate the top of the cylinder and the other end of the slot is proximate the middle of the cylinder. Bolt 123 extends through the bore 126 of the cylinder and threads into the internally threaded cylinder 20 which projects from the back face 18 of the frame. The bolt may be turned to snug the shoulder 28 of the bolt against the cylinder in order to hold the cylinder from rotating and to prevent movement of the support 24 with respect to the frame 12. It will be noted that the lateral extent of the bore 126 is greater than diameter of the bolt 23. The tag 141 of the hinged mount is received by the slot 147 of the cylinder 143.

In use of the applicator of FIGS. 7 through 9, bolt 23 may be loosed, freeing support 24 to slide so as to extend or retract the rollers 36 with respect to the base 13 of the frame, limited only by bolt 23 contacting the edge of through bore 126. Furthermore, with the bolt loosed, arcuate supports 145 permit cylinder 143 to rotate about its longitudinal axis. However, rotation of cylinder 143 registers different portions of slot 147 with tag 141. Consequently, due to the angle of the slot, rotation of the cylinder changes the angle of the hinged mount with respect to the frame. Once the rollers 36 have been moved a desired amount below base 13 of the frame and the hinged mount has been tilted to a desired angle, the bolt may again be snugged against the cylinder 143 to lock the cylinder 143 against rotation and the support 24 against sliding. Because the lateral extent of the through bore 126 is greater than the diameter of the bolt 123, the cylinder has freedom to rotate when its axis of rotation (which passes through the center of the through bore) is not concentric with the longitudinal axis of the bolt.

The ability to adjust the angle of the hinged mount 137, and hence the angle of incline of the roller axles 34 toward the base of the frame, makes the applicator of FIGS. 7 through 9 more versatile than the applicator of FIGS. 1 through 3. That is, this applicator may be used with a wider variety of moulding geometries.

Figure 10:
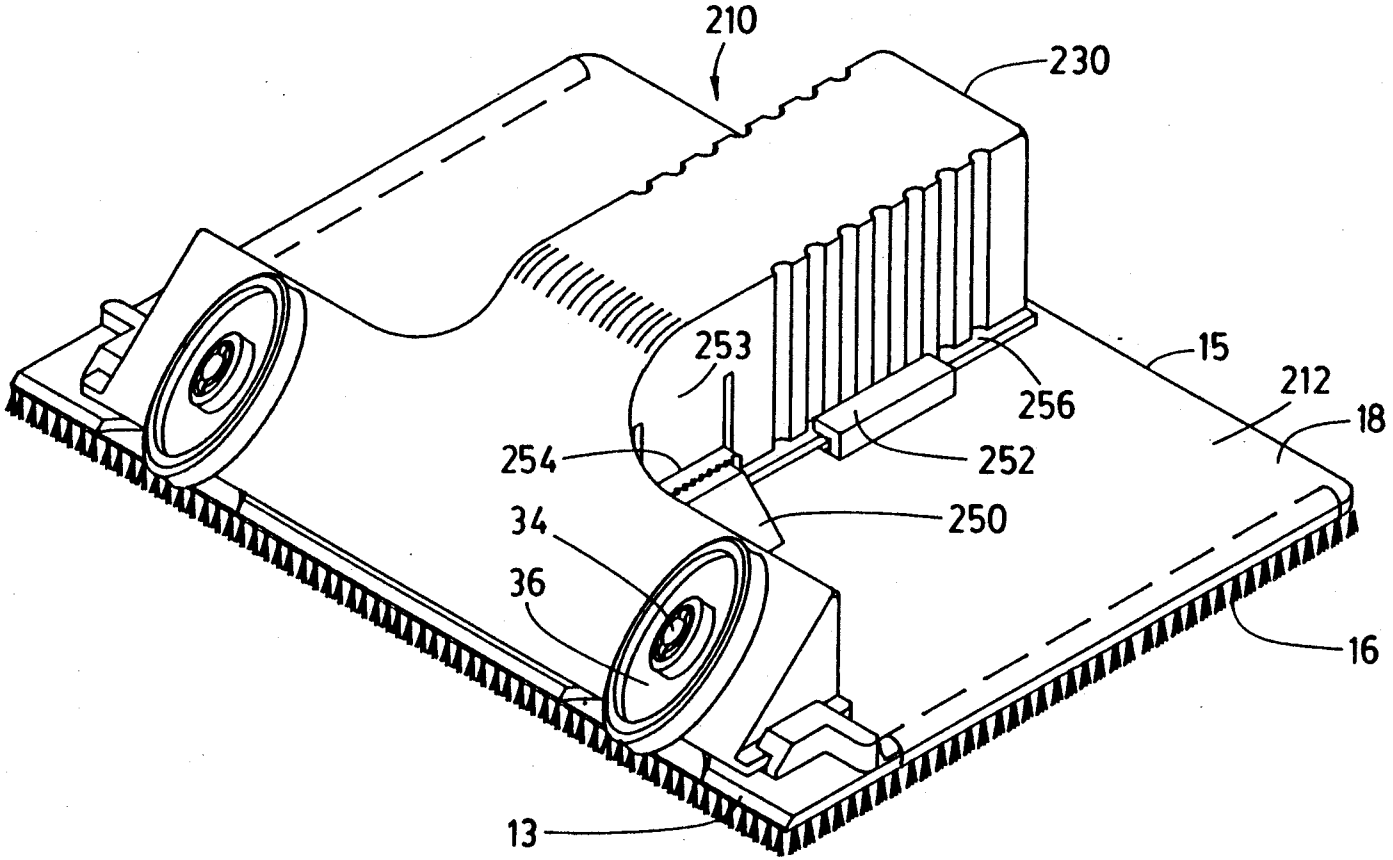
FIG. 10 is a perspective view of a paint applicator made in accordance with another aspect of this invention.

FIG. 10 illustrates another embodiment for the paint applicator of this invention. Turning to FIG. 10, wherein like parts have been designated with like reference numerals, a pair of opposed toothed projections 250 project from the back surface 18 of frame 212. A pair of inverted L-shaped supports 252 also project from the back surface 18 of frame 212. Sliding support 224 comprises handle 230 supporting a pair of resilient arms 253 terminating in toothed sections 254. The teeth of toothed section 254 are sized for interengagement with the teeth of projections 250. The handle 230 also comprises rails 256 which extend between arms 253 and the end of the handle and underlie the L-shaped supports 252.

In operation, an operator may slide sliding support 224 along frame 212 by pinching arms 253 in order to release the interengagement of the teeth of sections 254 and projections 250. For proper operation of the device, the relative positioning of the sliding support 224 with respect to frame 212 is such that there is interengagement between some of the teeth of the toothed sections 254 and projections 250.

Figure 11:
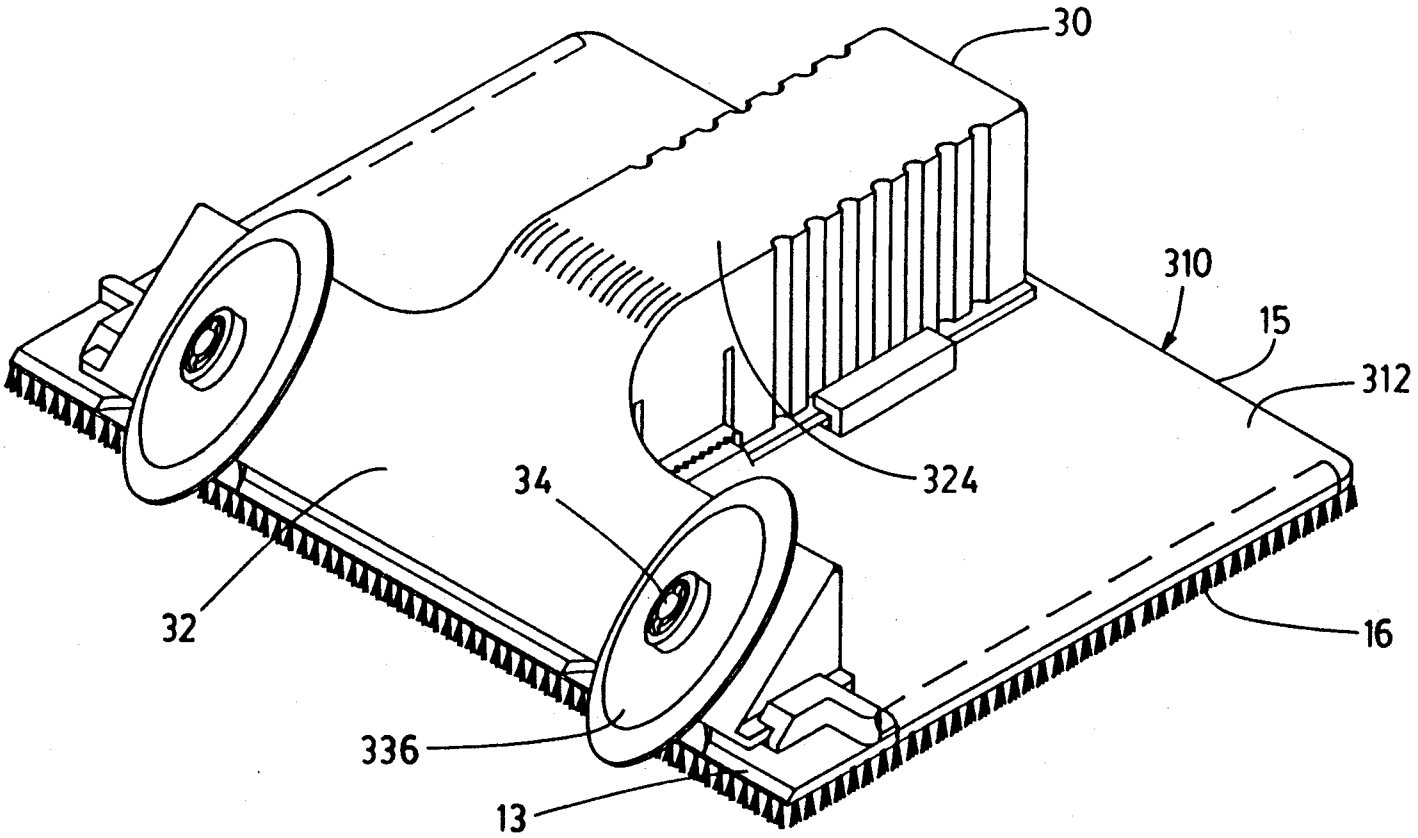
FIG. 11 is a perspective view of a paint applicator made in accordance with another embodiment of this invention.
Figure 12:
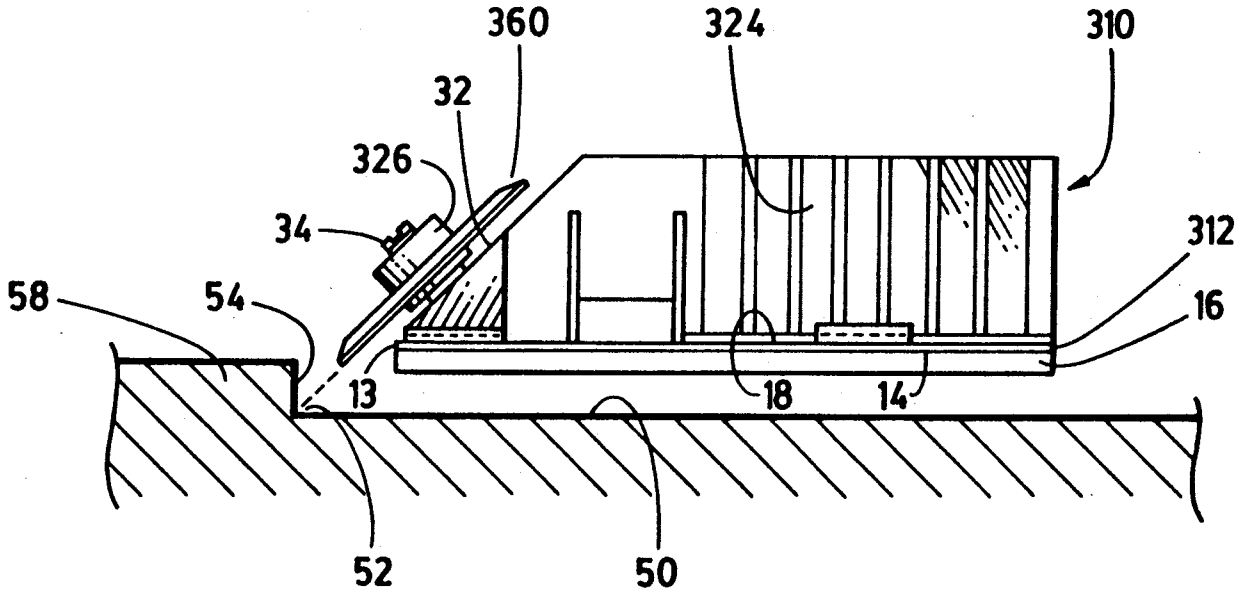
FIG. 12 is a side view of the paint applicator of FIG. 11.

FIGS. 11 and 12 illustrate another embodiment for the paint applicator of this invention. Turning to these figures, wherein like parts have been designated with like reference numerals, paint applicator 310 comprises sliding support 324 having a basal oblique face 32 from which two laterally spaced parallel axles 34 project normally. Each axle carries a roller 336 such that the rollers project below the bottom margin 13 of the frame 312 and forwardly of the front face 14 of the frame 312. The rolling face 360 of roller 336 is knife-edged.

With reference to FIG. 12, in use, the paint absorbent pad 16 of paint applicator 310 may be placed against a first surface 50 proximate a second, locating, surface 54 such that the knife edged rolling face 360 of roller 336 is received in inside corner 52 between surfaces 50 and 54. Rollers 336 thereby support the absorbent pad 16 in spaced relation to the second surface 54. By adjustment of the position of sliding support 324 relative to frame 312, the distance between the absorbent pad and surface 54 may be selected. In this regard, it may be noted that since rollers 336 project forwardly of front face 14 of frame 312, the minimum distance between which may be set between the absorbent pad and surface 54 is that at which the rollers abut the bottom margin 13 of the frame 312.

Figure 13:
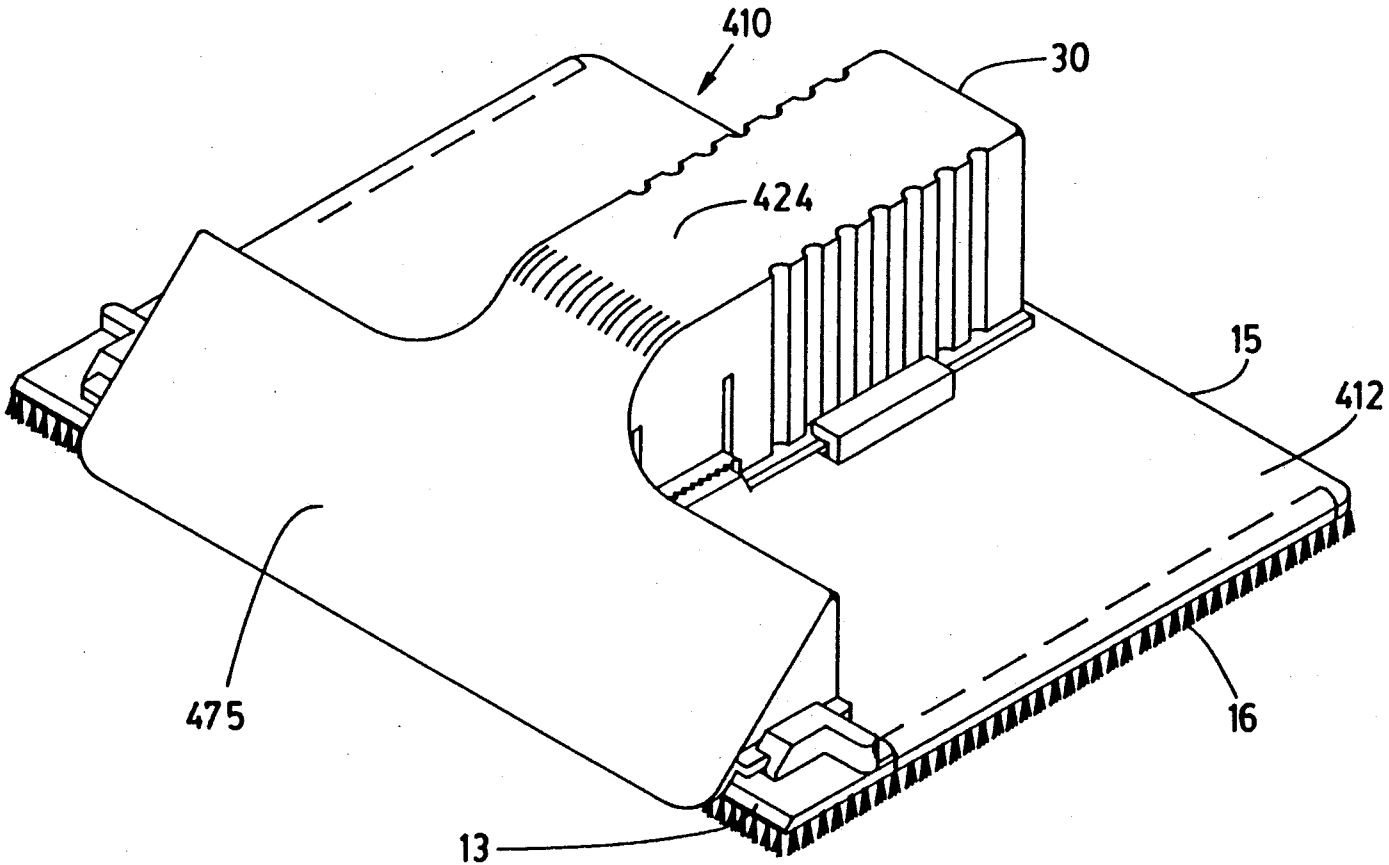
FIG. 13 is a perspective view of a paint applicator made in accordance with a further embodiment of this invention.
Figure 14:
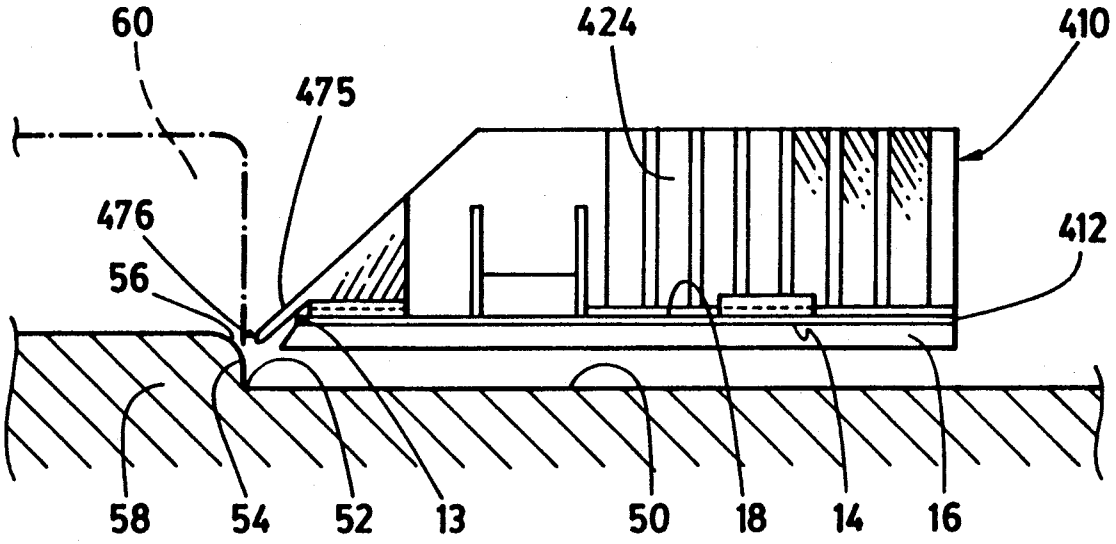
FIG. 14 is a side view of the paint applicator of FIG. 13.

FIG. 13 and 14 illustrate a further embodiment of the paint applicator of this invention. Turning to these figures, wherein like parts have been designated with like reference numerals, the sliding support 424 of paint applicator 410 comprises oblique abutment 475 which terminates in knife edge 476 below bottom margin 13 of frame 412 and forwardly of front surface 14 of frame 412. The abutment extends along most of the length of the frame 412.

With reference to FIG. 14, in use, when a paint absorbent pad 16 carried by paint applicator 410 is placed against a first surface 50 proximate a second surface 54, knife edge 476 of abutment 475 may abut the inside corner 52 between the first surface 50 and second surface 54. The abutment 475 thereby supports the absorbent pad 16 above surface 54 at a distance which depends upon the relative position of sliding support 424 and frame 412 set by an operator. Because abutment 475 extends along the majority of the length of the frame 412 — and hence along the majority of the length of the pad 16 — - when the knife edge 476 is received by inside corner 52, the abutment 475 forms a seal between the first and second surfaces 50, 54 reducing the possibility that any paint which reached the knife edge would pass through such seal to the second surface.

If, prior to the application of any paint to absorbent pad 16, the paint applicator 410 is run along a first surface 50 with the knife edge 476 of abutment 475 in inside corner 52, any stipples or other irregularities in the inside corner may be cleaned off by the knife edge. This helps in providing a straight edge support surface for abutment 475.

Other modifications will be apparent to those skilled in the art and, accordingly, the invention is defined in the claims.

What is claimed is:

1. A paint applicator for applying paint to the edge of a first surface which forms an inside corner with a second surface, comprising the following:

a frame having a flat front face for carrying a paint absorbent pad and a back face;

a handle on the back face of said frame;

a pair of rollers spaced along the handled back face of said frame having generally parallel axes of rotation inclined toward one margin of said frame such that said rollers project beyond said margin of said frame and forwardly of said flat front face, the rolling face of each of said rollers comprising a knife edge, whereby, when a paint absorbent pad is carried by said flat front face of said frame and such pad abuts a first surface proximate an inside corner with a second surface, the knife edged rolling face of each of said rollers is intended to abut said inside corner where said first and second surfaces meet to thereby support said absorbent pad in spaced relation to said second surface.

2. The paint applicator of claim 11 wherein said rollers are carried by a sliding support, said sliding support including adjustment means such that the distance said rollers project beyond said margin of said frame may be adjusted.

3. The paint applicator of claim 2 wherein said adjustment means comprise a pair of resilient toothed projections carried on said back face of said frame, one on either side of sliding support, and a corresponding pair of toothed segments on said sliding support for interengaging with said toothed projections.

* * * * *

UNITED STATES PATENT AND TRADEMARK OFFICE

CERTIFICATE OF CORRECTION

PATENT NO. : 5,209,781

DATED : May 11. 1993

INVENTOR(S) : Terry H. Milkie

It is certified that error appears in the above-indentified patent and that said Letters Patent is hereby corrected as shown below:

Column 6, line 44, delete "11" and insert —1—.

Signed and Sealed this

Eleventh Day of January, 1994

Bruce Lehman

*Attest:*

BRUCE LEHMAN

*Attesting Officer*

*Commissioner of Patents and Trademarks*